United States Patent [19]

Leach et al.

[11] Patent Number: 4,934,102

[45] Date of Patent: Jun. 19, 1990

[54] SYSTEM FOR MECHANICAL PLANARIZATION

[75] Inventors: Michael A. Leach, Bristol; James K. Paulsen, Jericho; Brian J. Machesney, Burlington; Daniel J. Venditti, Essex Junction; Christopher R. Whitaker, Jericho, all of Vt.

[73] Assignee: International Business Machines Corporation, Armonk, N.Y.

[21] Appl. No.: 253,028

[22] Filed: Oct. 4, 1988

[51] Int. Cl.[5] ..... B24B 5/00; B24B 3/00

[52] U.S. Cl. ..... 51/50 R; 51/48 R; 51/103 R; 51/104; 51/105 R

[58] Field of Search ..... 51/113.1, 103 R, 104, 51/105, 106 R, 283 R, 237 R, 50 R

[56] References Cited

U.S. PATENT DOCUMENTS 1,899,463 2/1933 Howard ..... 51/80 A 2,536,444 1/1951 Hamilton ..... 51/80 A

*Primary Examiner*—Frederick R. Schmidt

*Assistant Examiner*—Mark F. Frazier

*Attorney, Agent, or Firm*—Sughrue, Mion, Zinn, Macpeak & Seas

[57] ABSTRACT

A polishing tool for abrasively polishing a semiconductor wafer that edge clamps the wafer between two rollers. The wafer is spun-up in one plane and the rollers spin in a second plane which is orthogonal to the wafer spin plane. One of the rollers is split with each section rotating in opposite directions. Each of the rollers is mounted by a spring-gimballed assembly to follow the wafer contour.

20 Claims, 4 Drawing Sheets

SYSTEM FOR MECHANICAL PLANARIZATION

BACKGROUND OF THE INVENTION

1. Field Of The Invention

This invention relates to a system which mechanically polishes wafers used in the manufacture of semiconductor elements.

2. Prior Art

As semiconductor elements become increasingly smaller, for example VLSI technology the wiring technology associated with such devices requires smaller wiring pitches. Additionally a multitude of interconnect levels are present. As each wiring level is added during device fabrication, those coincident steps cause the surface topography to become increasingly severe. Wafers which have initially rough surfaces create difficulties with each succeeding processing, step such as photolithography, RIE etching, insulation and metalization. Thus, a standing requirement in the manufacture of semiconductor devices is to begin with wafers which have a high degree of planarization. One known technique is mechanical planarization however the tools which perform this step are manually loaded, require excessive setup time and the wafers must be reloaded into a brush cleaning tool following planarization. Thus an initial deficiency in the prior art is the lack of a system which has high throughput rates yet achieves a high degree of planarization on such wafers. One known wafer polishing tool is illustrated in FIG. 1. This tool mechanically polishes wafers by holding the wafer substrate against a rotating wheel. That is, a wafer 10 is manually placed in a wafer template 12 and positioned on the large polishing wheel 14. The template fits in a rotating holder 16 which in turn is held in place by an arm 18 to provide the necessary pressure against the wheel 14. A slurry is dispensed near the holder 16 as the wheel 14 and holder 16 rotate. FIG. 2 illustrates the directions of movement. As the action progresses, insulator is first removed from the projecting steps causing the topography to become planer. Uniform insulator removal is accomplished by adjusting holder rotation speed and pressure. A computer model may be used to interact the variables and establish the speed of holder 16 which will maximize uniformity for a given speed of polish wheel 14. Thus, as illustrated in FIG. 2, while the *large* polishing wheel 14 rotates in a counterclockwise direction, the smaller holder itself also rotates. In general, because the diameter of wafer holder 16 is less than the radius of polishing wheel 14, oscillatory motion of holder 16 between the edge and center of wheel 14 may be used to further improve the uniformity of material removal. The rotating holder 16 presses the wafer against the polish wheel 14 with a pressure in the range of 10 pounds per square inch. This prior art polishing apparatus has several deficiencies. As wafer diameter increases, the cost and size of such a conventional polishing tool increase dramatically. Moreover, since the wafer is being pressed against the polish wheel at a high pressure, any non-uniformity in either the rear surface of the wafer or the apparatus that contacts the rear surface of the wafer will produce non-uniform material removal at the polish surface. Finally, because material removal rate is proportional to the differential velocity between the Wafer and the polishing wheel, the wafer surface is subjected to a continuum of polish rates if the wafer is held stationary. This non-uniformity in polishing rates can be addressed by varying the wafer spin speed with respect to the speed of the rotating polish wheel. However, in theory the material removal rate can be made only 95% uniform for an 8 inch wafer being polished on a 22 inch polishing wheel.

Reference is made to IBM Technical Disclosure Bulletin, Vol. 21, No. 7, December 1978, p. 2733, "Controlled Wafer Backside Polishing" which discloses the concept of controlling the polish rate and thus polish profile by introducing discontinuities in the abrasive surface of the polish wheel.

Reference is made to U.S. Pat. Nos. 1,899,463; 2,536,444; 3,748,677: 3,907,471 and 4,256,535 which are representative of polishing devices which use one or more flat horizontally rotating polishing wheels. U.S. Pat. No. 1,899,463 employs upper and lower polishing rollers to simultaneously polish two sides of a workpiece U.S. Pat. No. 2,536,444 employs a series of opposed grinding drums to polish the surface of the strip material and U.S. Pat. No. 3,748,677 employs a rotating carrier for wafers to transport wafers in succession between two opposed rotating brushes.

In U.S. Pat. No. 1,899,463, the vertically rotating rollers are set mechanically parallel to each other. In the context of the 463 Patent polishing on both sides of the workpiece is achieved. The system is not satisfactory for single-sided polishing where a high degree of precision is required.

SUMMARY OF THE INVENTION

Given the deficiencies of the prior art, it is an object of this invention to provide a device for polishing one side of a round, flat disc to a high degree of precision and uniformity.

Yet another object of this invention is to use a lower roller assembly which is spring loaded against the upper roller with the wafer interposed between them, thus defining a natural parallelism between the surface of the wafer to be polished and the upper roller. In accordance with this invention, by employing a floating lower roller assembly, in the presence of an abrasive pad or slurry uniform film thickness removal occurs while planarizing one side of the wafer. This object of the present invention is accomplished by employing a floating gimbal design for the lower roller.

Yet another object of this invention is to define a system for mechanically polishing silicon wafers to a high degree of planarity while reducing the drag on the rotating wafer, yet at the same time adequately supporting the polishing surface. This object of the present invention is accomplished by employing a split lower roller mechanism. The lower roller is split to reduce the drag on the rotating wafer while providing the necessary support function.

These and other objects of this invention are accomplished in a novel wafer polishing tool where the wafer is positioned between the upper roller and the lower split roller, and the wafer axis being orthogonal to the roller axes. As indicated herein, the lower roller is mounted by a spring-and-gimbal such that it follows the contours of the wafer. The wafer is rotated at high speeds relative to the rollers to maximize both uniformity and polish rate.

This invention will be described in greater detail by referring to the attached drawing and the description of the preferred embodiment which follows.

DESCRIPTION OF THE PREFERRED EMBODIMENT

Figure 1:
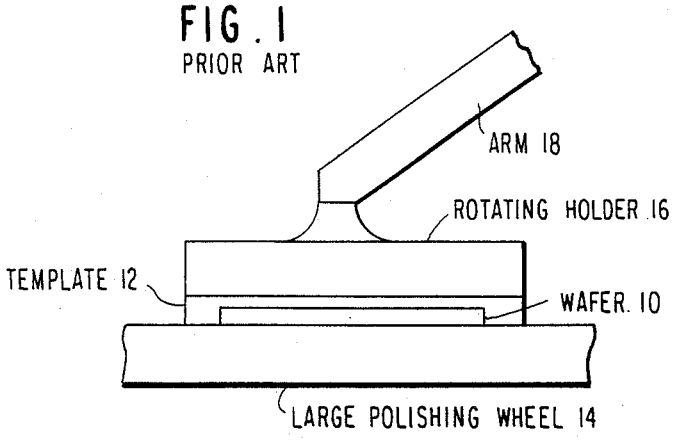
FIG. 1 PRIOR ART
FIG. 1 is a side view of a prior art wafer polishing tool.
Figure 2:
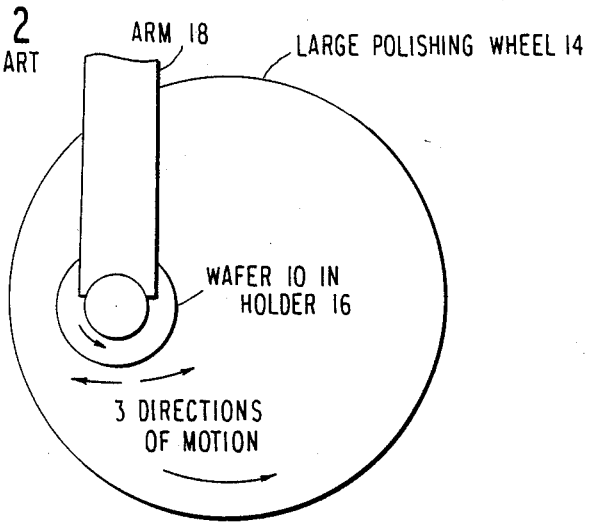
FIG. 2 PRIOR ART
FIG. 2 is a top view of the prior art wafer polishing tool of FIG. 1
Figure 3:
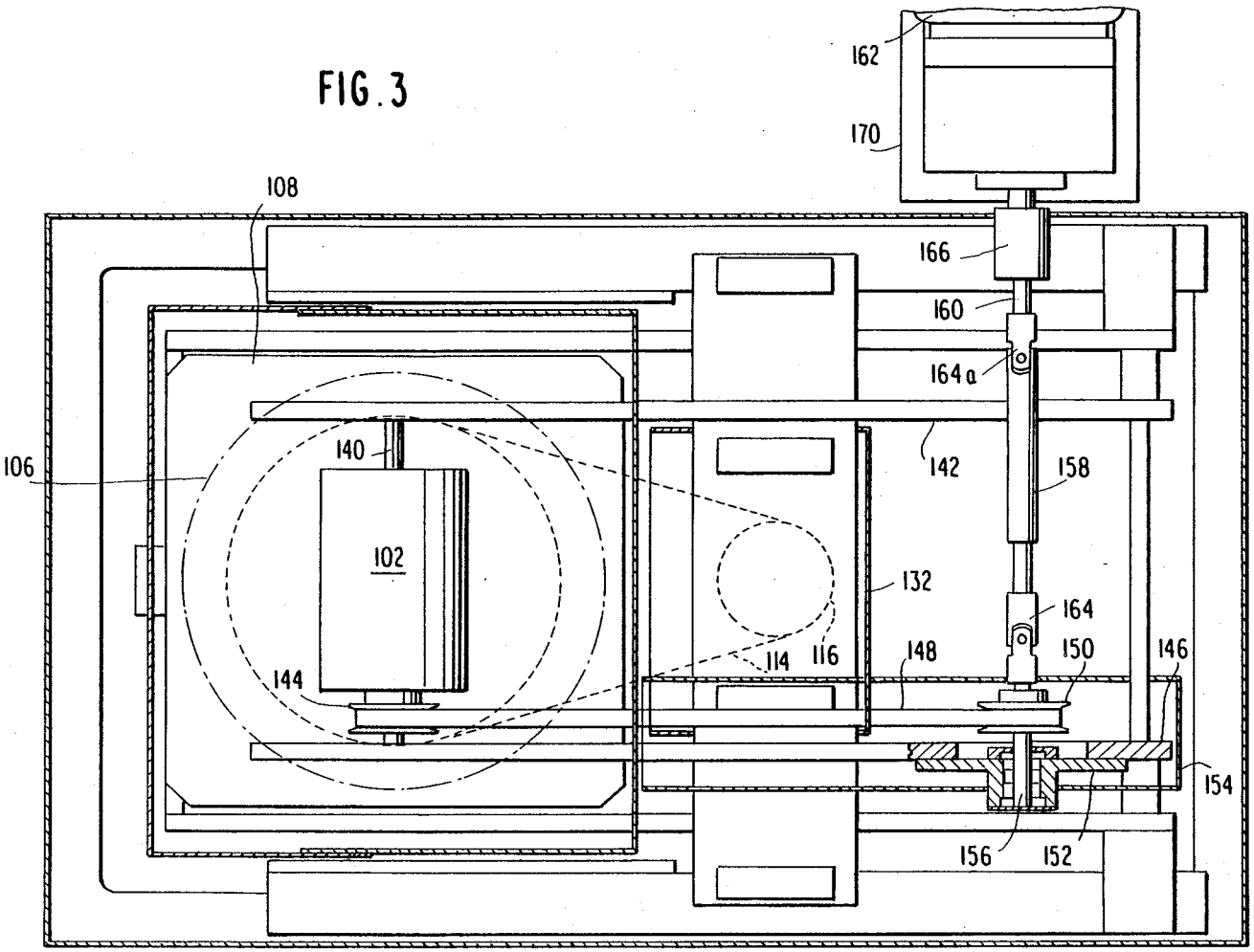
FIG. 3 is a top view of the system in accordance with this invention.
Figure 4:
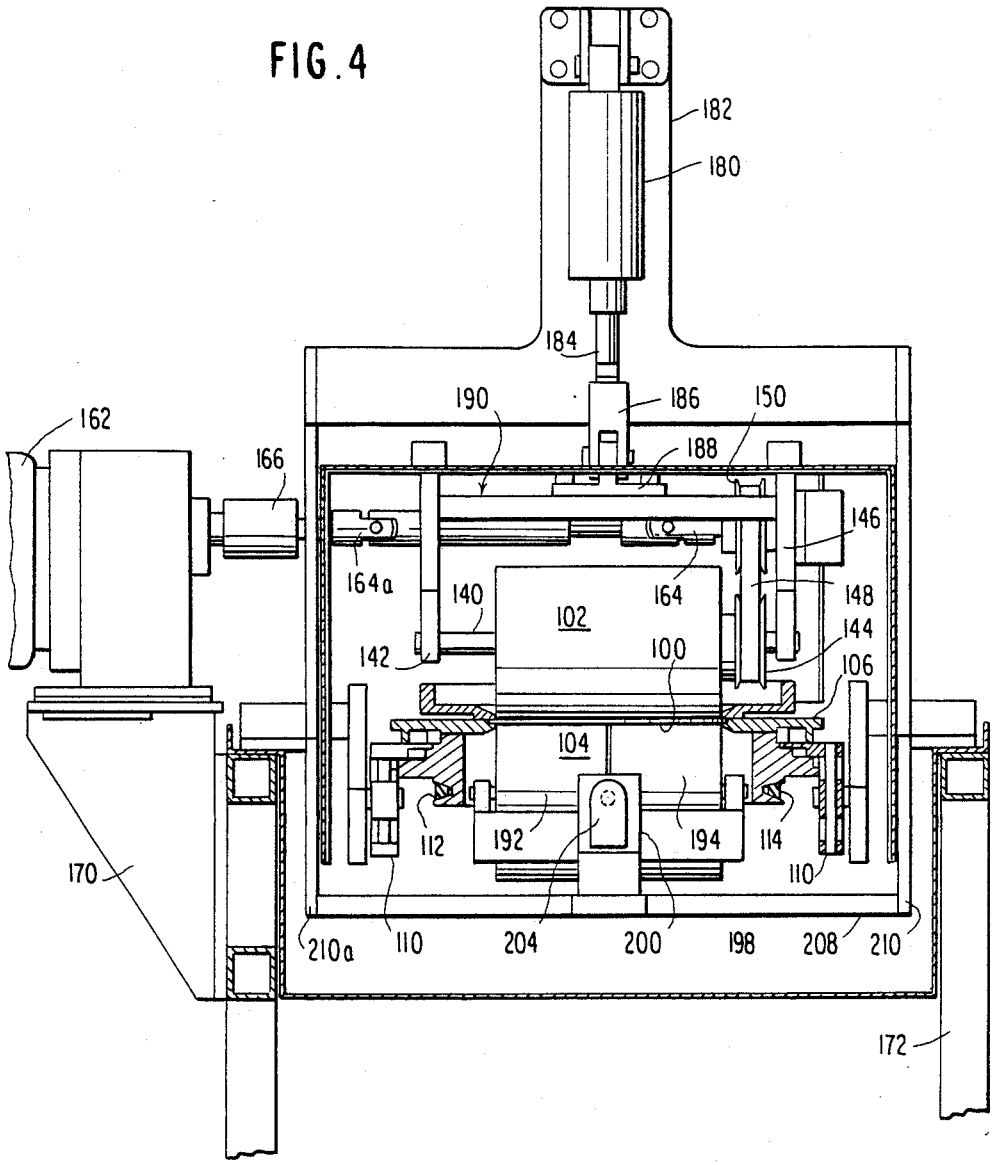
FIG. 4 is a front view of the system in accordance with this invention.
Figure 5:
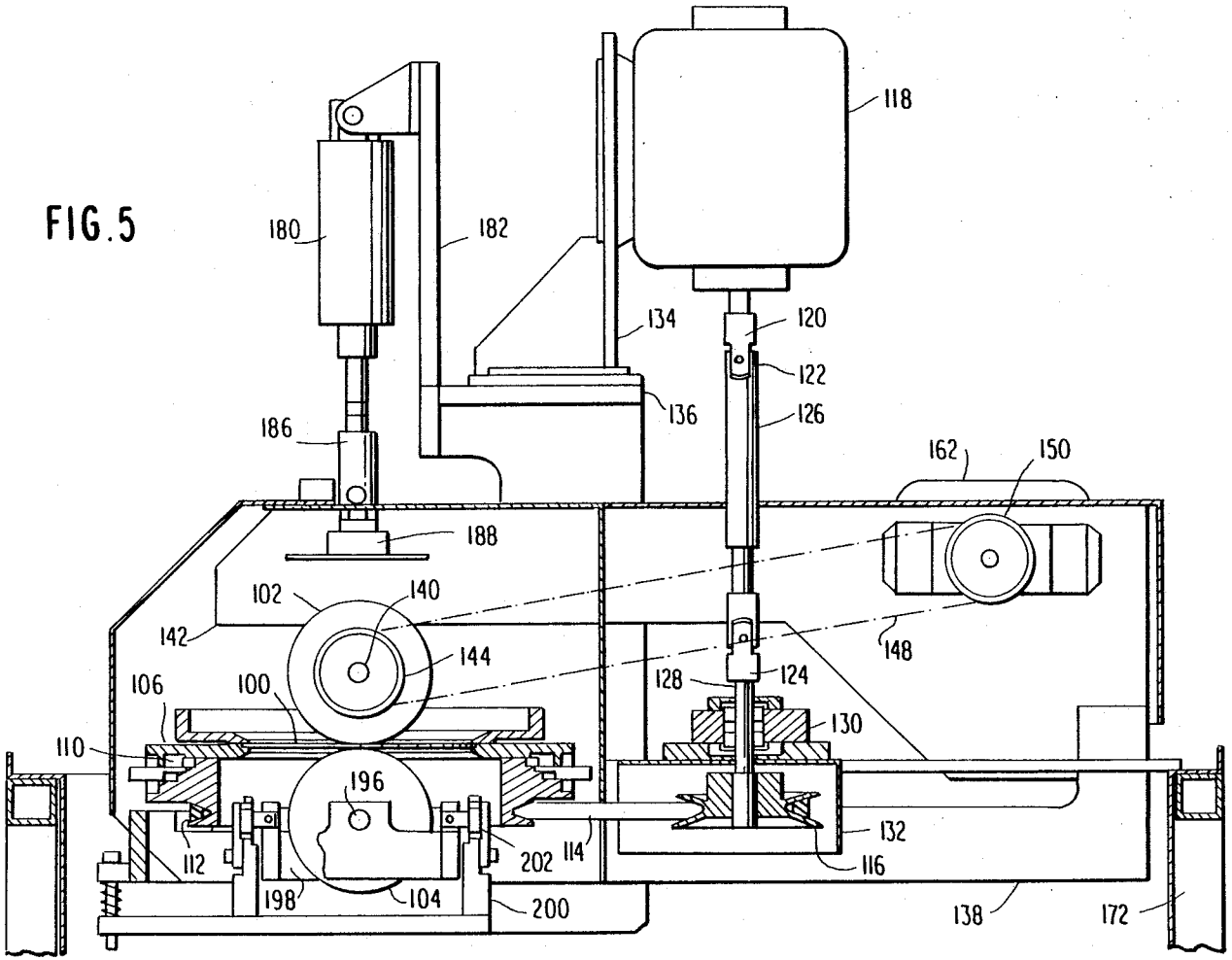
FIG. 5 is a side view of the system of this invention.

Referring now to FIGS. 3, 4 and 5 the preferred embodiment of this invention will be described. A wafer 100 to be polished is positioned between two rollers, an upper roller 102 and a lower roller 104. The wafer 100 is clamped at its perimeter between two annular rings which comprise part of free-floating wafer holder 106. The wafer holder 106 has a floating plate 108 supported at each of its four corners by means of spring and bearing assemblies 110.

As illustrated in the Figures, the free-floating support for the wafer holder allows movement relative to the upper roller 102 and the lower roller 104. In accordance with this invention, the wafer holder 106 is formed with a circular pulley having a groove 112 that engages a belt 114. The belt 114 is driven by a drive pulley 116 which is in turn rotated by a motor 118 through output shaft 120. A pair of universal couplings 122 and 124 compensate for any misalignment in the system via transmission shaft 126. An output shaft 128 coupled to the pulley 116 passes through a bearing assembly 130 which in turn is mounted to a frame 132. The frame 132 also supports a shield to cover the pulley 116 as illustrated in FIG. 5.

The motor 118 which is used to spin the wafer 100 on the wafer holder 106 is, in turn, mounted onto a weldment motor mount 134. A motor plate 136 is fixedly mounted to 2 side plate which is in turn fixedly mounted to frame weldment 172. The motor 118 may be a Bodine Model No. 224, it being understood that any other precision high-speed motor can be used as a source of power to rotate the wafer.

The upper roller 102 is mounted on a shaft 140. One end of the shaft 140 is journaled for rotation about a drive support plate 142. On the opposite end of the upper roller 102, a pulley 144 is mounted on the shaft 140. The shaft 140 is journaled for rotation on a drive support plate 146. As will be described herein, the support plates 142 and 146 provide a flexible mounting for the upper roller 102 which allows it to be pushed down to apply a force on the wafer. The pulley 144 has a drive belt 148 which provides the drive transfer mechanism to the shaft 140 from a drive pulley 150. The drive pulley 150 is mounted for rotation through a bearing and shaft assembly 152, that assembly, in turn, being mounted on a drive support plate 146.

The pulley shaft 156 is coupled to a drive shaft 158 via a universal joint 164. As in the case of the motor for driving the wafer holder, the drive shaft 158 is coupled to the output shaft 160 of a drive motor 162 through a universal joints 164 and **164*a* to compensate for any relative movement. As illustrated in FIG. 3, an adapter shaft 166 may be provided to provide a positive coupling between the output shaft of the motor and the drive shaft 160**.

The motor 162 is mounted on a motor mount weldment 170 which is, in turn, coupled to a frame 172.

Pressure must be applied to the upper roller 102 for polishing to occur. Pressure is applied to the upper roller 102 by a cylinder 180 which is at one and fixedly mounted to a frame 182 which is, in turn, coupled to the same plate 136 used to mount the motor 118, the cylinder, typically a Clippard No. CDR-24 has approximately a one-inch stroke. It will be appreciated that other cylinders having a sufficient working stroke may be used. Output is provided by shaft 184 which is coupled by means of a clevis adapter 186 to a plate 188 mounted on a linkage plates 142 and 146.

As illustrated in FIG. 5, the shaft 140 to which the upper roller 102 is mounted is, in turn, mounted onto plate 142 and 146. Consequently, as the output of the cylinder is adjusted pressure is transmitted to the upper roller via the linkage comprising the clevis 186, the linkage plate 188 and the plate 142 and 146. The effect is to move the shaft 140 downward toward the wafer 100 which has been mounted on the wafer support 106. Consequently, the upper roller 102 is flexibly mounted to allow it to be pushed down and apply force to the wafer. As the wafer position shifts, the pulley 144 is integrally mounted on the shaft, tension on the belt 148 however, remains the same since the movement of the pulley is a very small distance with respect the lateral run of the belt 148. Thus, substantially constant tension is maintained on the belt.

The lower roller 104 is formed into two split sections comprising elements 192 and 194. As illustrated inFIG. 4, the lower roller sections 192 and 194 are mounted on a shaft 196 which is journaled in a frame 198. The frame 198 is gimbaled in one direction to allow the lower roller axis 196 to move in two dimensions. This accounts for any wafer backside non-uniformities. Specifically as illustrated in FIGS. 4 and 5, the frame 198 is mounted to a housing 200 via a pair of journaled gimbals 202 and 204. The frame 200 is mounted on a plate 208 which, in turn, is coupled to side supports 210 and **210*a* coupled to the frame of the unit illustrated as element 172**.

In its most basic mode of operation then, the wafer spins in substantially a horizontal plane, although it effectively free-floats between the upper roller 102 and lower roller 104 together with wafer holder 106. The upper driven roller 102 has pressure applied to it by cylinder 180 so that the wafer is polished by an abrasive pad or slurry. Any surface irregularities in the lower roller are compensated by having the split lower roller 104. Given the rotation of the wafer 100, it is apparent that the right hand portion 194 of the lower roller will rotate in a direction opposite to that of the left hand portion 192 of the lower roller.

With this configuration, one of the primary difficulties of prior art polishing apparatus systems has been overcome. Specifically, in those systems the wafer is pressed against the polish wheel at such a high pressure that any nonuniformities at either the rear surface of the wafer or in the apparatus which contacts the rear- surface of the wafer wall, in turn, produce a non-uniform material removal at the polish surface. Such is overcome in this system fully gimballing and splitting the lower roller section.

The relative speed between the spinning wafer and the upper roller has a significant effect on the material removal rate. In the prior art, the wafer surface effectively sees a plurality of polish speeds. That is, given the difference in radii, between that of the wafer and that of the polishing table, the outside of the wafer will polish faster th inside. The prior art addresses this non-uniformity by varying the wafer spin speed with respect so that of the rotating table. However, the polishing surface can be made only approximately 95% side uniform for an 8 inch wafer being polished on a 22 inch polishing wheel. In this invention, the axis of rotation of the upper roller is parallel to the wafer diameter On one side of the wafer s center, the upper roller and wafer travel in the same direction; on the other side they travel in opposite directions. For a given point along the wafer surface, the differential velocity of the spinning wafer to the rotating polish pad is *directly proportional* to the distance from that point to the center of the wafer. At the same time, the dwell period (i.e. the amount of time the same point along the wafer is actually beneath the polishing pad) is *inversely proportional* to the distance from that point to the center of the wafer. Since the amount of material removed by polishing is a function of the product of the differential velocity and the dwell time, the above proportionalities cancel. This is not true for those portions of the wafer in constant contact with the polish pad (i.e. the wafer center). Thus, except for the wafer center, material polishing is constant over the entire wafer surface.

Importantly, in accordance with this invention the after may be spun at speeds far greater than those which are used in prior art systems. By increasing the speed of wafer rotation, the amount of pressure which is required to polish a given amount of material at a given time is reduced. This, in turn, increases wafer uniformity.

Utilizing this invention, polishing can achieve uniformity in the range of 98–99%. Additionally, given the speed of polishing, more wafers can be processed in a given amount of time, thereby increasing the overall throughput of the system while decreasing the cost of the overall manufacturing process.

It is apparent that variations of this is be practiced without departing from the essential scope thereof. For example, both the lower support roller and the upper roller could powered to provide simultaneous two-sided wafer polishing.

We claim:

1. A polishing tool for removing a quantity of material from a workpiece comprising:

a base;

an abrasive member flexibly mounted on the base, means for rotating said abrasive member about a first axis of rotation;

a support member holding said workpiece, means for flexibly mounting said support member on said base, means for rotating said support member about a second axis of rotation orthogonal to said first axis; and a split follower roller disposed below said support member and flexibly mounted on the base for supporting said workpiece in engagement with said abrasive member, said split follower roller rotating about a third axis of rotation parallel to said first axis.

2. The polishing tool of claim 1 further comprising means to urge said abrasive member into contact with said workpiece,

3. The polishing tool of claim 2 wherein said means to urge said abrasive member into contact comprises a cylinder having a movable output shaft, said output shaft operably coupled to said abrasive member.

4. The polishing tool of claim 3 further comprising a frame for flexibly mounting said abrasive member of the base, a shaft passing through said abrasive member and having a pulley mounted thereon, said shaft mounted on said frame and said output shaft coupled to said frame.

5. The polishing tool of claim 1 wherein said means for rotating said abrasive member comprises a motor mounted to said base, said motor having an output shaft journaled for rotation by a bearing mounted on said base, and a universal joint for compensating any misalignment between said output shaft and said bearing.

6. The polishing tool of claim 1 wherein said means for flexibly mounting said support member on said base comprises a series of bearings supporting said support member in a symmetrical manner to permit said support member to shift relative to said abrasive member.

7. The polishing tool of claim 1 wherein said means for rotating said support member comprises a motor mounted to said base and having an output shaft, a drive pulley journaled for rotation and mounted to said base a universal joint coupling said drive pulley to said output shaft and a belt coupled to said drive pulley and said support member.

8. The polishing tool of claim 1 wherein said split follower roller comprises two roller elements mounted for rotation on a common shaft, said roller elements having a combined length substantially the same as said abrasive member and said split follower roller mounted on said abrasive member with said workpiece positioned therebetween.

9. The polishing tool of claim 8 wherein said common shaft is mounted on a first frame element, a second frame element journaled for rotation to said base and said first frame element gimbaled to said second frame element.

10. The polishing tool of claim 9 wherein said split follower roller is positioned inside said support member, means to urge said abrasive member into contact with said workpiece and said split roller having a splitting aligned with said means to urge.

11. A polishing tool for abrasively polishing a wafer comprising:

a base;

an abrasive member positioned relative to said wafer to polish one surface, said abrasive member flexibly mounted to said base to shift relative to said wafer, means for rotations said abrasive member about a first axis of rotation;

a support member holding said wafer about an edge thereof, means for flexibly mounting said support member on said base to permit said wafer to shift relative to said based means for rotating said support member about an axis of rotation in a second plane perpendicular to said first plane; and a split follower roller, freely rotating in response to rotation of said wafer and supporting said wafer and maintaining it in engagement with said abrasive member, said split follower roller rotating about an axis of rotation in said first plane.

12. The polishing tool of claim 11 further comprising means to urge said abrasive member into contact with said workpiece.

13. The polishing tool of claim 12 wherein said means to urge said abrasive member into contact comprises a cylinder having a movable output shaft, said output shift operably coupled to said abrasive member.

14. The polishing tool of claim 13 further comprising a frame for flexibly mounting said abrasive member on the base, a shaft passing through said abrasive member and having a pulley mounted thereon, said shaft mounted on said frame and said output shaft coupled to said frame.

15. The polishing tool of claim 11 wherein said means for rotating said abrasive member comprises a motor mounted to said base, said motor having an output shaft journaled for rotation by a bearing mounted on said base, and a universal joint for compensating any misalignment between said output shaft and said bearing.

16. The polishing tool of claim 11 wherein said means for flexibly mounting said support member on said base comprises a series of bearings supporting said support member in a symmetrical manner permit said support member to shift relative said abrasive member.

17. The tool of claim 11 wherein said means rotating said support member comprises a motor mounted to said base and having an output shaft, a drive pulley journaled for rotating and mounted to said base a universal joint said drive pulley to said output shaft a belt coupled to said drive pulley and support member.

18. The tool of claim 11 wherein said split roller comprises two roller elements mounted for rotation on a common shaft, said roller elements having a combined length the same as said abrasive member and said follower roller mounted on said base at a position symmetrical with said abrasive member with said workpiece positioned therebetween.

19. The tool of claim 18 wherein said common shaft is mounted on a first frame element, a second frame element journaled for rotation to said base and said first frame element gimbaled to said second frame element.

20. The polishing tool of claim 19 wherein said split follower roller is positioned inside said support member, means to urge said abrasive member into contact with said workpiece and said split roller having a split line aligned with said means to urge.

* * * * *